United States Patent [19]

Sakai et al.

[11] Patent Number: 4,639,871

[45] Date of Patent: Jan. 27, 1987

[54] GLOW PLUG HEATING CONTROL APPARATUS FOR A DIESEL ENGINE

[75] Inventors: Tuguyasu Sakai, Toyohashi; Hideaki Namba, Oobu; Masahiro Ohba, Okazaki, all of Japan

[73] Assignee: Nippondenso Co., Ltd., Kariya, Japan

[21] Appl. No.: 576,479

[22] Filed: Feb. 2, 1984

[30] Foreign Application Priority Data

Feb. 3, 1983 [JP] Japan ..... 58-16526

[51] Int. Cl.[4] ..... F02P 19/02

[52] U.S. Cl. ..... 364/431.10; 123/493; 123/179 H; 219/519

[58] Field of Search ..... 364/431.10; 123/491, 123/493, 179 H, 179 L, 179 BG, 145 A, 325; 219/202, 492, 497, 508, 519

[56] References Cited

U.S. PATENT DOCUMENTS

| | | | |
|---|---|---|---|
| 3,735,742 | 5/1973 | Aono et al. | 123/493 |
| 4,148,283 | 4/1979 | Harada et al. | 123/493 |
| 4,350,876 | 9/1982 | Kubota et al. | 219/519 |
| 4,399,781 | 8/1983 | Tsukasaki | 123/179 H |

FOREIGN PATENT DOCUMENTS

| | | | |
|---|---|---|---|
| 2743788 | 4/1979 | Fed. Rep. of Germany | 123/179 H |
| 0005143 | 1/1979 | Japan | 123/179 H |
| 56-39868 | 4/1981 | Japan . | |
| 0113969 | 7/1982 | Japan | 123/179 H |

*Primary Examiner*—Parshotam S. Lall

*Attorney, Agent, or Firm*—Cushman, Darby & Cushman

[57] ABSTRACT

A control apparatus for diesel engines controls the energization of glow plugs each of which is disposed in a cylinder of a diesel engine and heated by an energizing current flowing therethrough. When fuel supply to the engine is resumed after the engine temperature has fallen due to the interruption of fuel supply during a decelerating operation of the engine and further when fuel supply is enriched during an accelerating operation of the engine while it is cold, the control apparatus controls the energization of the glow plugs, thereby promoting the combustion of the engine and improving the combustion efficiency of the engine.

9 Claims, 3 Drawing Figures

GLOW PLUG HEATING CONTROL APPARATUS FOR A DIESEL ENGINE

BACKGROUND OF THE INVENTION

1. Field of the Invention

The present invention relates to a control apparatus for diesel engines equipped with glow plugs which are energized to generate heat, and more particularly to a control apparatus for a diesel engine which control the heat generation of the glow plugs in association with the control of the combustion stroke of the engine.

2. Description of the Prior Art

In the past, glow plugs have been used in a diesel engine mainly for the purpose of preheating before the start of the engine and the after glow operation after the start of the engine. Japanese Utility Model Application Laid-Open (Kokai) No. 56-39868 may for example be cited as an example of such prior art glow plugs.

However, conventional control apparatuses have been unable to meet the requirements for various operating conditions of a diesel engine. In other words, the operating condition of a diesel engine changes from time to time in accordance with environmental conditions and demands of a driver, so that, under these various operating conditions, e.g., during a decelerating operation of a vehicle mounted with the diesel engine, where cut-off of fuel supply to the engine occasionally causes a rapid drop in the engine temperature, conventional control apparatuses have been unable to meet effectively the requirements for such an operating condition of the engine.

SUMMARY OF THE INVENTION

It is an object of the present invention to provide a control apparatus for diesel engines which can solve the foregoing problem in the prior art.

To accomplish the above object, on the basis of the results of experiments which showed that the temperature of a diesel engine falls rapidly in connection with particular fuel supply conditions, it is a feature of this invention to provide a control apparatus which is connected to an energization circuit for glow plugs so that the glow plugs are energized in response to the respective conditions in which fuel is supplied to the engine.

DESCRIPTION OF THE PREFERRED EMBODIMENTS

Figure 1:
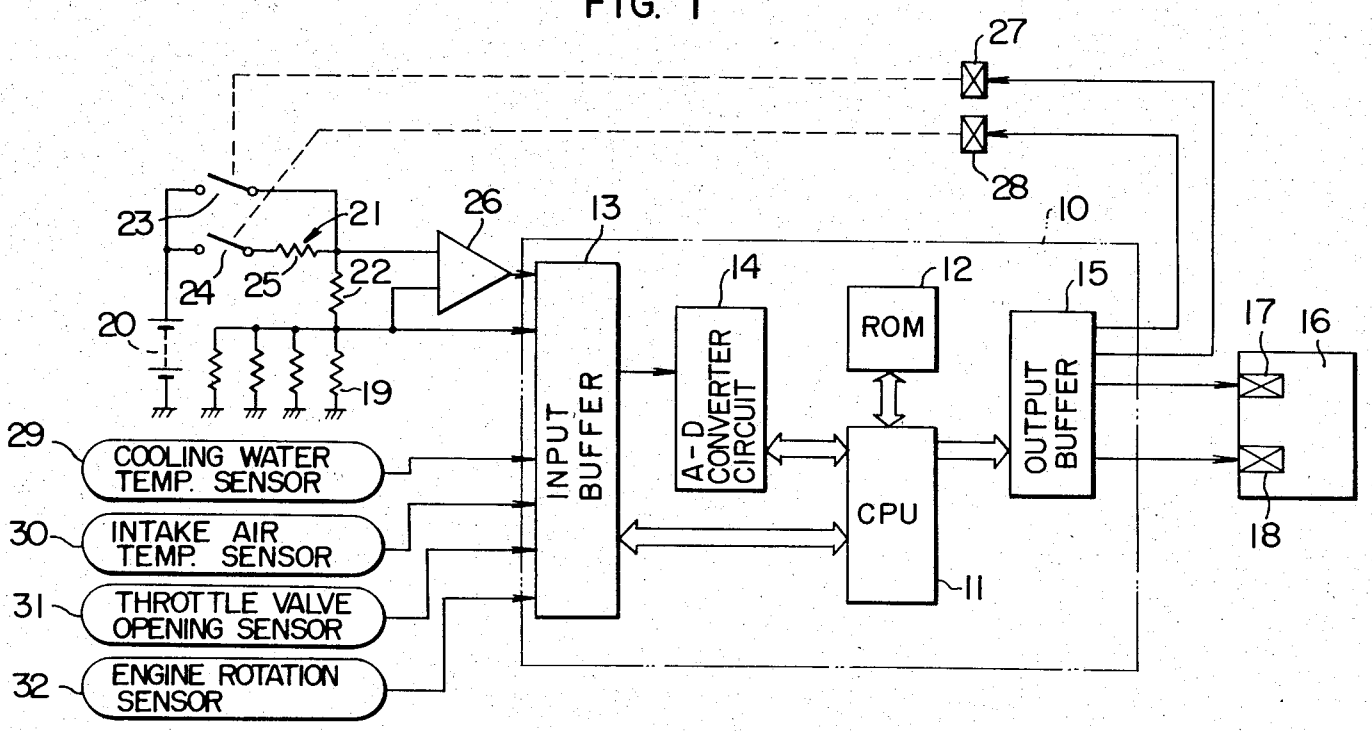
FIG. 1 shows the overall construction of a control apparatus for diesel engines of an embodiment of this invention.

The present invention will now be described with reference to an embodiment thereof shown in the accompanying drawings. FIG. 1 shows the overall construction of a control apparatus for diesel engines embodying the present invention. Numeral 10 designates a digital computer constituted by a microcomputer. In the computer 10, a central processing unit 11 performs a series of computing operations in accordance with the control program and control functions which are stored in a program memory (ROM) 12. The input data required for the operations performed by the CPU 11 are taken in from external input units through an input buffer 13 having a multiplexer and an A-D converter circuit 14 in the execution of instructions determined by the control program in the course of execution of the control program. In addition, the CPU 11 supplies control output signals to external apparatuses through an output buffer 15 under specified conditions in the execution of instructions determined by the control program.

A fuel injection device 16 is shown as an operating element for a diesel engine which element is controlled by the computer 10. The fuel injection device 16 is of a known construction including a first operating unit 17 responsive to an electric signal for adjusting the quantity of fuel injection and a second operating unit 18 responsive to another electric signal for adjusting the timing of fuel injection.

Further, glow plugs 19 are provided as a unit for preheating the diesel engine which unit is also controlled by the computer 10. There are provided the same number of glow plugs as the engine cylinders, and each of the glow plugs is arranged in respective one of the engine cylinders. The glow plugs 19 are connected electrically in parallel with one another. They have a positive resistance-temperature coefficient, and, for example, they have a characteristic such that the value of their resistances increases linealy with an increase in the temperature thereof.

An energizing circuit for the glow plugs 19 is formed to supply an electric current to the glow plugs 19 from a dc battery 20 via a current adjusting circuit 21 and a current detecting resistor 22 having a small resistance value of a preselected resistance-temperature coefficient. The current adjusting circuit 21 comprises a first switch 23, a series circuit of a second switch 24 and a current limiting resistor 25, whereby an electric current is supplied to the glow plugs 19 directly from the battery 20 when the first switch 23 is closed and an electric current is supplied to the glow plugs 19 from the battery 20 through the current limiting resistor 25 when only the second switch 24 is closed. When both switches 23 and 24 are open, no current is supplied to the glow plugs 19. Thus, the current adjusting circuit 21 switches the value of the energization current between two levels by opening and closing the first and second switches 23 and 24. The resistance values of the glow plugs 19 and the current limiting resistor 25 are selected so that, upon closing the first switch 23, the glow plug temperature increases rapidly due to a relatively large energization current thereby to exceed an upper limit of a desired temperature range, while, upon closing only the second switch 24, a relatively small current flows thereby to decrease gradually the glow plug temperature and stabilize it at a value which is around a lower limit of the desired temperature range or below.

The energization of the glow plugs 19 is controlled by the computer 10 in connection with the control of the fuel injection device 16 so that the quantity of their heat generation is thereby controlled. Although the description of this embodiment does not refer thereto in detail, the energization of the glow plugs 19 is controlled by the computer 10 for the purpose of the heating before the start of the engine and the after glow operation after the start of the engine in the same way as conventional glow plugs do. As means for energizing the glow plugs 19, in accordance with this invention the glow plugs 19 can be used in combination with any temperature adjusting means provided that a suitable quantity of heat generation is ensured. In this embodiment, the temperature of the glow plugs 19 due to their own heat generation as well as the heat generated by the engine operation is measured, and the measured value is compared with a preset desired value, thereby controlling the current adjusting circuit 21 to bring the glow plug temperature within the desired temperature range.

This embodiment provides a method for determining the resistance value of the glow plugs 19 as one of the methods for measuring the glow plug temperature. For this purpose, a voltage drop across the current detecting resistor 22 and the potential at the junction point of the current detecting resistor 22 and the glow plugs 19 are utilized. In this case, the voltage drop across the current detecting resistor 22 is amplified by a differential amplifier 26, and, under the instruction of the CPU 11, the output voltage of the differential amplifier 26 and the junction point potential are converted to digital values through the input buffer 13 and the A-D converter circuit 14 and the digital values are supplied to the CPU 11. In the first place, the CPU 11 stores the digital values in an internal temporary memory RAM therein (not shown), and then it computes the glow plug temperature on the basis of the digital values in accordance with the control program.

Electromagnetic actuators 27 and 28 are provided to effect the opening and closing of the first switch 23 and the second switch 24 of the current adjusting circuit 21, respectively, in response to output signals of the computer 10.

The computer 10 is connected to necessary external signal generating means through the input buffer 13 in order to control the fuel injection device 16 and the glow plugs 19. In this embodiment, the computer 10 is connected to a temperature sensor 29 for detecting the cooling water temperature of the engine, an intake air temperature sensor 30 for detecting the intake air temperature of the engine, a throttle valve opening sensor 31 for detecting an engine load and an engine rotation sensor 32 for detecting an engine speed. These sensors 29 to 32 are publicly known in the art.

Figure 2:
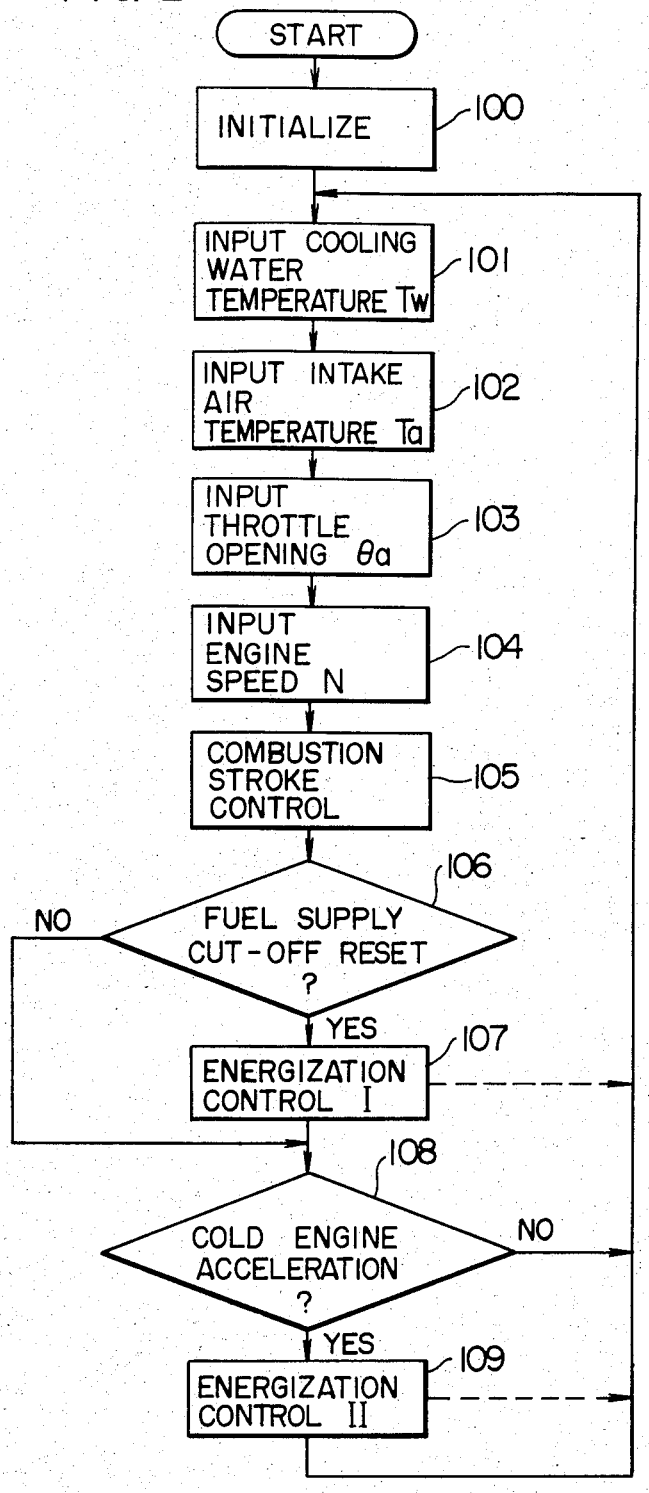
FIG. 2 is a flow chart showing the outline of an engine control program.

FIG. 2 shows schematically the control program executed by the CPU 11, that is, a series of processing steps which are executed by the computer 10 in accordance with the control program preset in the ROM 12. In the like manner as a general control program, the control program comprises a combination of inputting, processing and outputting steps, and the steps of the operational processings executed in accordance with the control program of this invention will now be described with reference to the accompanying drawings.

When the engine key switch (not shown) is closed, the computer 10 is fed from a vehicle-mounted battery through a suitable voltage regulator circuit, and the execution of the control program is started at a start step where the power supply is turned on. Then, at an instruction step designated by a step 100, the internal temporary memory (RAM), registers, input/output ports, etc. are set into a predetermined initial state (initialization).

At steps 101 through 104, the computer 10 receives through its input circuit necessary data for determining the fuel injection quantity and fuel injection timing. Firstly, at the step 101 the temperature data from the engine cooling water temperature sensor 29 is converted to a digital value through the input buffer 13 and the A-D converter circuit 14 and then stored in the RAM of the CPU 11. This digital value is hereinafter referred to as a digital value Tw. At the step 102, the intake air temperature data from the intake air temperature sensor 30 is similarly received as a digital value Ta. At the step 103, the throttle opening data from the throttle valve opening sensor 31 is received as a digital value $\theta a$. At the step 104, the data based on the pulse train signal from the engine rotation sensor 32 is received as a digital value N. Only, as regards the engine speed data N, the input buffer 13 reshapes the pulse train signal from the sensor 32 to make the period of the pulse train signal clear and then transfers the data to the CPU 11 without passing through the A-D converter 14. The CPU 11 computes the period of the pulse train signal in accordance with a known time measuring program and stores the result of the computation as the digital value N in the temporary memory.

A step 105 generally shows a procedure for the control of the fuel injection device 16 by the computer 10. At this combustion stroke control step 105, the computer 10 determines optimum values of the fuel injection quantity and fuel injection timing in accordance with the digital values Tw, Ta, $\theta a$ and N received from the input circuit. A known method for determining basic values from the throttle valve opening $\theta a$ and the engine speed N may be adopted in a program for determining the fuel injection quantity and fuel injection timing.

In addition, the combustion stroke control step 105 includes several known correcting operations performed according to control conditions. For example, the step 105 may perform correcting operations for correcting the basic values in accordance with the cooling water temperature Tw and the intake air temperature Ta to obtain the final fuel injection quantity and fuel injection timing. Further, the step 105 includes a fuel supply interruption processing for the decelerating operation of the engine and a fuel supply enrichment operation for the cold engine acceleration, both of which are also known in the art.

In this case, the fuel supply interruption processing compares the data $\theta a$ stored in the temporary memory with preset reference data to decide a condition that the throttle valve opening $\theta a$ is smaller than a preset opening value (corresponding to a substantially fully closed state). When this condition is detected, the CPU 11 fixes the fuel injection quantity to a value of zero or nearly zero independently of the result of the computation of the basic values.

On the other hand, the fuel supply enrichment operation is performed on the basis of both decisions that the engine is cold and that the opening rate of the throttle valve opening $\theta a$ is great. The decision as to whether the engine is cold or not is made, for example, by comparing the cooling water temperature data Tw stored in the temporary memory with preset reference data and/or comparing the intake air temperature data Ta with preset reference data, thereby determining whether the former is lower than the latter. While, the decision on the throttle valve opening rate is made by comparing a quantity of a change $\Delta\theta a$ in the throttle valve opening data $\theta a$ taken at preset time intervals (the quantity of the changes is computed sequentially) with preset reference data, thereby determining whether the opening rate of the throttle valve is great or not. When these conditions are satisfied, during a predetermined time or a suitable time the CPU 11 increases the fuel injection quantity by adding to the basic fuel injection quantity a preset increment and/or, when required, an increment determined in accordance with the cooling water temperature Tw and the opening rate of the throttle valve opening $\theta a$.

At a step 106, the CPU 11 decides whether the first glow plug energization control step (I) at a next step 107 should be executed. The decision is made on the following three items. The first item is to decide whether it is proper timing for performing the processing of the step 107 in accordance with a count of a timer counter which is not shown. Here, it is arranged that the processing of the step 107 is performed at intervals of 50 msec, for example. The second item is to decide whether the fuel supply interruption processing has terminated (has been reset) after the processing has once been performed. The third item is to decide whether one sequence of processing at the step 107 has been completed after the initiation of the processing at the step 107.

When the result of the decision on the three items at the step 106 is YES, upon resetting of the fuel supply interruption processing, the computer 10 executes at the step 107 the first energization control step (I) at predetermined time periods until a sequence of processings is completed. When the result of the decision at the step 106 is NO, the processing jumps to a step 108. The details of the first energization control step (I) at the step 107 will be described later with reference to FIG. 3.

At the step 108, the CPU 11 decides whether a second glow plug energization control step (II) at a next step 109 should be executed. The decision is made on the following three items. The first item is to decide whether the second energization control step (II) at the step 109 is executed, for example, at intervals of 50 ms. The second item is to determine whether the processing of the fuel supply enrichment operation has once been initiated. The third item is to determine whether a sequence of processings of the step 109 has been completed. Upon initiation of the fuel supply enrichment operation for cold engine acdeleration, the computer 10 executes at the step 109 the second energization control step (II) at predetermined time periods until a sequence of processings is completed. The details of the second energization control step (II) at the step 109 will also be described hereunder with reference to FIG. 3.

Figure 3:
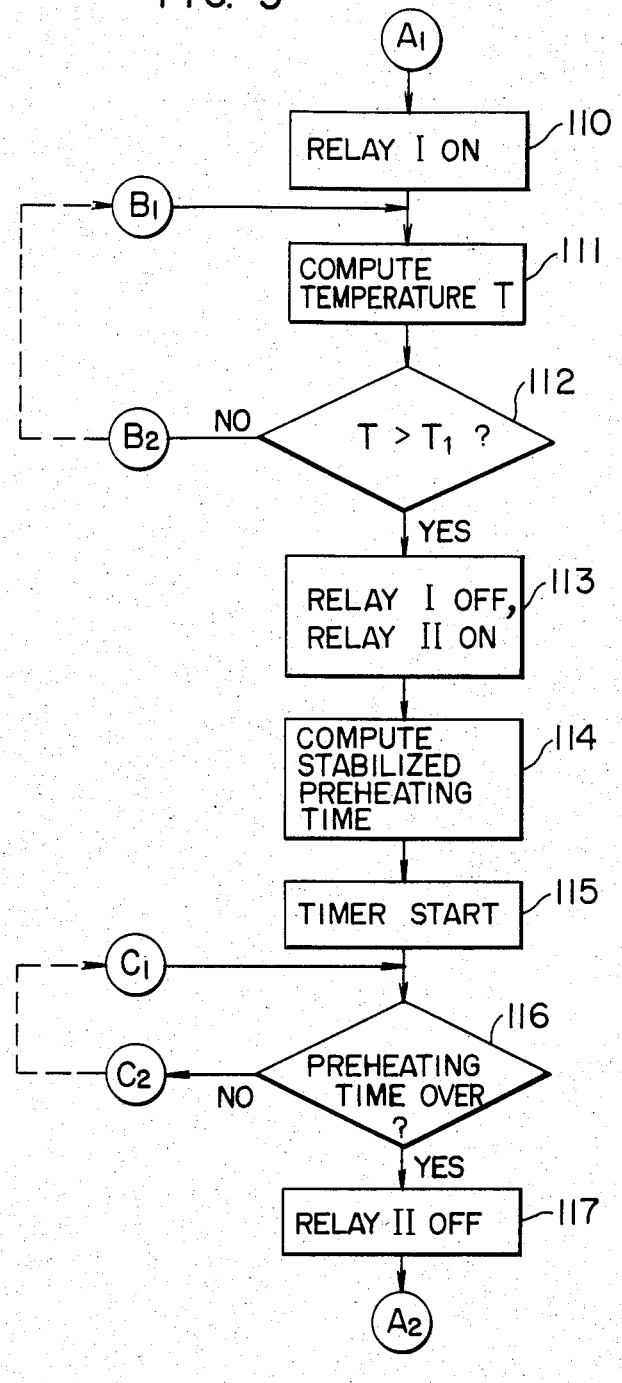
FIG. 3 is a flow chart showing a glow plug energization control program forming the principal part of the flow chart shown in FIG. 2.

FIG. 3 shows the details of the processing steps of the first and second energization control steps (I) and (II) at the steps 107 and 109, respectively, shown in FIG. 2. It should be noted that FIG. 3 shows a common example for explaining the processings of the steps 107 and 109, but each of the steps 107 and 109 is formed as a separate program. However, a temperature computing step 111, for example, may be formed as a commonly available subroutine program.

When, for example, a condition is established for executing the first energization control step 107, the computer 10 starts the processing at a point $A_1$ and executes a sequence of processings until it terminates at a point $A_2$. If a point $B_2$ is reached in the course of execution, the processing of the step 107 in this time ends. However, since the fact of reaching the point $B_2$ is retained in the temporary memory, the next processing of the step 107 starts from a point $B_1$. Further, if a point $C_2$ is reached in the course of execution, the next processing of the step 107 starts from a point $C_1$. The above fact applies in the same way to the processing of the second energization control step 109.

In FIG. 3, the computer 10 starts the energization control from a step 110. In accordance with the instruction stored in the step 110 of the control program, the CPU 11 energizes the electromagnetic actuator 27 through the output buffer 15 to close the first switch 23 of the current adjusting circuit 21. In this case, the electromagnetic actuator 28 may also be energized to close the second switch 24 at the same time. The current adjusting circuit 21 supplies an electric current to the glow plugs 19 from the battery 20 through the current detecting resistor 22. Since the resistance value of the current detecting resistor 22 is small and the rated voltage of the glow plugs 19 is selected to be lower than the normal voltage of the battery 20, each of the glow plugs 19 generates heat immediately and rises rapidly to a high temperature, thus reaching the upper limit of the desired temperature range in a few seconds.

As soon as the computer 10 has energized the electromagnetic actuator 27, the computer 10 performs the computation of the temperature T of the glow plugs 19 at the step 111. This computation is performed in accordance with the following procedure:

(1) The signals indicative of the voltage drop V across the current detecting resistor 22 and the potential E at the junction between the current detecting resistor 22 and the glow plugs 19 are successively supplied through the input buffer 13 and the A-D converter circuit 14 to the CPU 11 and stored in the temporary memory.

(2) In accordance with the preliminarily known resistance value (e.g., 10 mΩ) of the current detecting resistor 22 and the input data of the voltage drop (V), the value (I) of an electric current flowing through the glow plugs 19 is computed by using the following equation:

$$I(A)=100\cdot V(V)$$

(3) Where the number of the glow plugs 19 is 4, the resistance value $R_T$ of a glow plug 19 is computed by using the following equation and in accordance with the current value I and the input data of the potential E:

$$R_T(\Omega) = 4\cdot E(V)/I(A)$$
$$= E(V)/\{25\cdot V(V)\}$$

(4) In accordance with the resistance-temperature coefficient of the glow plugs 19 represented by the formula $R_T=K\cdot T+C$ (where K and C are constants), the glow plug temperature T is computed by using the following formula:

$$T=(R_T-C)/K$$

Since the constants K and C are known preliminarily, the foregoing computation procedure may be shown in a simpler form.

The computer 10 compares the temperature T of the glow plugs 19 computed at the step 111 with a reference value $T_1$ indicative of the upper limit of a preset desired temperature range. If the glow plug temperature has not yet reached the upper limit, the processing of the energization control step is stopped for a time at the point $B_2$. Then, upon expiration of 50 msec, the processing of the temperature computing step 111 is resumed from the point $B_1$ to decide whether the actual glow plug temperature has reached the upper limit. The processing of the steps 111 and 112 are repeated periodically until the glow plug temperature reaches the upper limit.

Further, in order to provide against a case where the processing continues passing through the point $B_2$ even after the lapse of a predetermined time from the generation of an instruction to energize the electromagnetic actuator 27 at the step 110 (namely, after the start of the processing of the energization control step), it is possible to add a fail-safe program for overriding the decision of the step 112 to de-energize the electromagnetic actuator 27.

When the temperature of the glow plugs 19 rises rapidly and it is decided that the desired upper limit temperature is reached, the processing of the CPU 11 advances from the step 112 to the step 113. At the step 113, the computer 10 produces an output control signal through the output buffer 15 to cause the electromagnetic actuator 27 to be de-energized and only the electromagnetic actuator 28 to be energized. Accordingly, in the current adjusting circuit 21 only the second switch 24 is closed, so that an electric current is supplied to the glow plugs 19 from the battery 20 through the current limiting resistor 25 and the current detecting resistor 22. As a result, the glow plug temperature falls gradualy toward a value near the lower limit of the desired temperature range and it remains stabilized there. Steps 114 through 117 act to determine the stabilized preheating time.

At the step 114, the CPU 11 computes the stabilized preheating time. Here, the CPU 11 may simply set a predetermined time. If necessary, the stabilized preheating time may be varied in accordance with the operating conditions of the engine. For instance, the stabilized preheating time may be increased as the cooling water temperature Tw or the intake air temperature Ta decreases. At the step 115, the CPU 11 starts the counting of an internal timer counter, and at the step 116 the CPU 11 checks whether the count value of the timer counter has reached a value corresponding to the time determined at the step 114. Also in this case, a similar procedure of causing the processing of the program to exit at the point $C_2$ and to resume at the point $C_1$ is repeated until the stabilized preheating time elapses. When the stabilized preheating time has elapsed, at the step 117 the CPU 11 produces an instruction to de-energize the electromagnetic actuator 28 through the output buffer 15, and thereby the glow plug energization through the second switch 24 ceases. Thus, the sequence of the glow plug energization control steps is completed.

Further, in the first energization control step 107 for the fuel supply interruption processing and the second energization control step 109 for the fuel supply enrichment operation, it is possible to change the set value for the upper limit value $T_1$ at the step 112 and/or the set value of the stabilized preheating time at the step 114, as occasion demands.

As described hereinabove, it is possible to improve the combustion efficiency of the engine by supplying an electric current to the glow plugs 19 through the energization of the first switch 23 and second switch 24 when fuel supply is resumed after the interruption thereof and during the cold engine acceleration, respectively, in connection with the engine operating conditions, particularly the fuel injection quantity.

Now summarizing the above-described embodiment, when fuel supply is enriched during the cold engine acceleration or the like, an endothermic action due to the fuel vaporization increases. However, by energizing the glow plugs to be heated thereby, it is possible to promote the combustion in an engine and to improve its acceleration performance. On the other hand, during the deceleration of an engine-mounted vehicle, especially when the vehicle goes down on a long descent with its accelerator pedal released, fuel supply is generally cut off and the cylinder temperature falls gradually. However, upon resumption of fuel supply after the interruption thereof, the energization of the glow plugs to heat them by the apparatus of this invention can promote the combustion efficiency of the engine.

Further, the present invention is not limited to the foregoing embodiment. For instance, in the construction of the above-described embodiment, it is possible to supply an electric current to the glow plugs 19 by using only one or the other of the first switch 23 and second switch 24 and to determine the energization time simply to be a suitable constant time instead of making a decision as to whether the desired temperature has been reached or not, as mentioned previously. Further, the present invention is also applicable to a case where the switching means in the glow plug energizing circuit comprises a single switch instead of a plurality of switches, namely, a first switch and a second switch. Further, the present invention is also applicable to cases where the energizing circuit comprises one or more semiconductor switches to effect chopper control of the energizing current of the glow plugs or where the conductivity of the semiconductor switches is controlled. Further, in the present invention, instead of using a microcomputer, an engine control computer and a separately constructed glow plug energization control circuit may be used, whereby a fuel supply interruption signal and/or a fuel supply enrichment signal are supplied from the engine control computer and in accordance with these signals the glow plugs are energized for a predetermined time or for a time period determined according to the engine cooling water temperature. From the foregoing, it will be seen that the present invention has a great advantage such that the combustion efficiency of a diesel engine can be improved by energizing the glow plugs arranged therein in accordance with the operating conditions of the engine.

We claim:

1. A glow plug heating control apparatus for a diesel engine having at least one glow plug energized by an electric current before and after a starting operation of said diesel engine for heating the same, said control apparatus comprising:

means for detecting a resumption of fuel supply to said diesel engine after a cut-off of fuel supply to said diesel engine during a decelerating operation, and producing a resumption output in response to said detected resumption;

means for detecting an enrichment of fuel supply to said diesel engine during an accelerating operation of said diesel engine under a cold engine condition, and producing an enrichment output in response to said detected enrichment during acceleration; and means for energizing said glow plug whenever one of: (a) said fuel supply resumption detecting means produces said resumption output, and (b) said fuel supply enrichment detecting means produces said enrichment output.

2. A control system according to claim 1, wherein said energizing means includes:

means for supplying said glow plug with a first electric current until the temperature of said glow plug reaches a predetermined value; and means for supplying said glow plug with a second electric current smaller than the first electric current during a predetermined time period after the temperature of said glow plug has reached the predetermined value.

3. A control system according to claim 1, wherein said energizing means includes:

a battery;

a first switch connected between said battery and said glow plug for supplying said glow plug with a first electric current therethrough until the temperature of said glow plug reaches a predetermined value;

a second switch connected between said battery and said glow plug for supplying said glow plug with a second electric current therethrough during a predetermined time period after the temperature of said glow plug has reached the predetermined value; and a resistor connected in series with said second switch and comprised in an electric circuit for supplying the second electric current, for limiting the second electric current to a value smaller than the first electric current.

4. A glow plug heating control apparatus for a diesel engine which has at least one glow plug energized by an electric current before and after a starting operation of said diesel engine for heating the same, said control apparatus comprising:

means for detecting a resumption of fuel supply to said diesel engine after a cut-off of fuel supply to said diesel engine during a deceleration operation; and means for energizing said glow plug in response to an output of said fuel supply resumption detecting means.

5. A control system according to claim 4, wherein said energizing means includes:

means for supplying said glow plug with a first electric current until the temperature of said glow plug reaches a predetermined value; and means for supplying said glow plug with a second electric current smaller than the first electric current during a predetermined time period after the temperature of said glow plug has reached the predetermined value.

6. A control system according to claim 4, wherein said energizing means includes:

a battery;

a first switch connected between said battery and said glow plug for supplying said glow plug with a first electric current therethrough until the temperature of said glow plug reaches a predetermined value;

a second switch connected between said battery and said glow plug for supplying said glow plug with a second electric current therethrough during a predetermined time period after the temperature of said glow plug has reached the predetermined value; and a resistor connected in series with said second switch and comprised in an electric circuit for supplying the second electric current, for limiting the second electric current to a value smaller than the first electric current.

7. A glow plug heating control apparatus for a diesel engine which has at least one glow plug energized by an electric current before and after a starting operation of said diesel engine for heating the same, said control apparatus comprising:

means for detecting an enrichment of fuel supply to said diesel engine during an accelerating operation under a cold engine condition; and means for energizing said glow plug in response to an output of said fuel supply enrichment detecting means.

8. A control system according to claim 7, wherein said energizing means includes:

means for supplying said glow plug with a first electric current until the temperature of said glow plug reaches a predetermined value; and means for supplying said glow plug with a second electric current smaller than the first electric current during a predetermined time period after the temperature of said glow plug has reached the predetermined value.

9. A control system according to claim 7, wherein said energizing means includes:

a battery;

a first switch connected between said battery and said glow plug for supplying said glow plug with a first electric current therethrough until the temperature of said glow plug reaches a predetermined value;

a second switch connected between said battery and said glow plug for supplying said glow plug with a second electric current therethrough during a predetermined time period after the temperature of said glow plug has reached the predetermined value; and a resistor connected in series with said second switch and comprised in an electric circuit for supplying the second electric current, for limiting the second electric current to a value smaller than the first electric current.

* * * * *